US008823258B2

(12) United States Patent
Ryowa et al.

(10) Patent No.: US 8,823,258 B2
(45) Date of Patent: Sep. 2, 2014

(54) LIGHT SOURCE, LIGHT-EMITTING DEVICE, LIGHT SOURCE FOR BACKLIGHT, DISPLAY DEVICE, AND METHOD FOR PRODUCING LIGHT SOURCE

(71) Applicant: Sharp Kabushiki Kaisha, Osaka (JP)

(72) Inventors: Tatsuya Ryowa, Osaka (JP); Yoshitaka Tomomura, Osaka (JP); Makoto Izumi, Osaka (JP); Kazunori Annen, Osaka (JP); Masato Ohno, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/828,857

(22) Filed: Mar. 14, 2013

(65) Prior Publication Data

US 2013/0249388 A1 Sep. 26, 2013

(30) Foreign Application Priority Data

Mar. 22, 2012 (JP) ..... 2012-066188

(51) Int. Cl.
*H05B 33/04* (2006.01)

(52) U.S. Cl.
CPC ..... *H05B 33/04* (2013.01); *Y10S 362/80* (2013.01)
USPC ..... 313/512; 362/800; 362/615; 362/97.1

(58) Field of Classification Search
None
See application file for complete search history.

(56) References Cited

U.S. PATENT DOCUMENTS

| | | | | |
|---|---|---|---|---|
| 2007/0164666 | A1* | 7/2007 | Oosono et al. | 313/504 |
| 2007/0278931 | A1* | 12/2007 | Mii | 313/489 |
| 2010/0096965 | A1 | 4/2010 | Oyaizu et al. | |
| 2011/0096560 | A1* | 4/2011 | Ryu et al. | 362/510 |
| 2012/0188772 | A1* | 7/2012 | Sakai et al. | 362/296.01 |
| 2012/0267997 | A1* | 10/2012 | Kijima et al. | 313/498 |
| 2013/0187540 | A1* | 7/2013 | Tischler | 313/512 |
| 2013/0200782 | A1* | 8/2013 | Hikmet et al. | 313/504 |

FOREIGN PATENT DOCUMENTS

JP 2010-123918 A 6/2010

* cited by examiner

*Primary Examiner* — Ashok Patel
(74) *Attorney, Agent, or Firm* — Birch, Stewart, Kolasch & Birch, LLP

(57) ABSTRACT

A fluorescent material-sealed sheet includes a plurality of fluorescent sections, an upper sealing section, and a lower sealing section, the plurality of fluorescent sections being sealed by the upper sealing section and the lower sealing section.

10 Claims, 7 Drawing Sheets

LIGHT SOURCE, LIGHT-EMITTING DEVICE, LIGHT SOURCE FOR BACKLIGHT, DISPLAY DEVICE, AND METHOD FOR PRODUCING LIGHT SOURCE

This Nonprovisional application claims priority under 35 U.S.C. §119 on Patent Application No. 2012-066188 filed in Japan on Mar. 22, 2012, the entire contents of which are hereby incorporated by reference.

TECHNICAL FIELD

The present invention relates to a light source, a light-emitting device which employs the light source, a light source for a backlight, a display device, and a method for producing a light source.

BACKGROUND ART

There has been known a light source which emits light of different colors in such a manner that (i) blue light or ultraviolet light is emitted from a light-emitting element such as an LED (light-emitting diode) and (ii) a fluorescent material is excited with the blue light or ultraviolet light thus emitted. Such a light source is disclosed in Patent Literature 1, for example.

A lighting device of Patent Literature 1 includes: a printed wiring board; a plurality of light-emitting elements which emit blue light; a sealing member; a color conversion unit; and an adhesive layer. The color conversion unit is arranged so that the blue light emitted from the plurality of light-emitting elements is incident on the color conversion unit. The sealing member has translucency, and is provided to seal the plurality of light-emitting elements provided on the printed wiring board. The color conversion unit includes a translucent cover member and a fluorescent material layer provided on a back surface of the translucent cover member. The adhesive layer has translucency. The sealing member and the fluorescent material layer of the color conversion unit tightly adhere to each other via the adhesive layer so that there is no gap (i) between the sealing member and the adhesive layer and (ii) between the fluorescent material layer and the adhesive layer.

CITATION LIST

Patent Literature 1

Japanese Patent Application Publication, Tokukai, No. 2010-123918 A (Publication Date: Jun. 3, 2010)

SUMMARY OF INVENTION

Technical Problem

However, the technique, described in Patent Literature 1 and the like, have the following problems.

That is, a color conversion unit of a light-emitting device disclosed in Patent Literature 1 or the like has a multi-layer structure which (i) is formed by carrying out screen printing with respect to a cover member and (ii) is then caused to adhere to a sealing member. For this reason, the light-emitting device has a complicated structure. Further, in a case where the light-emitting device described in Patent Literature 1 or the like is mounted, it is necessary to ensure an airtight state strictly (i) between the cover member and a fluorescent material layer and (ii) between the fluorescent material layer and the sealing member which seals an LED element.

Furthermore, the color conversion unit of the light-emitting device described in Patent Literature 1 or the like is uniquely provided for only the light-emitting device, and is not intended to be provided in other light-emitting devices.

The present invention is made in view of the problems. An object of the present invention is to provide a light source having an airtight property, a light-emitting device which employs the light source, a light source for a backlight, a display device, and a method for producing a light source.

Solution to Problem

In order to attain the above object, a light source in accordance with the present invention includes: a plurality of fluorescent sections each emitting fluorescent light upon receipt of excitation light from an excitation light source; and a sealing member, having translucency, for sealing the plurality of fluorescent sections.

In order to attain the above object, a method for producing a light source in accordance with the present invention includes the steps of: (a) forming a first sealing layer having translucency; (b) forming, on the first sealing layer formed in said step (a), a plurality of fluorescent sections each emitting fluorescent light upon receipt of excitation light from an excitation light source; and (c) forming, on the plurality of fluorescent sections formed in said step (b), a second sealing layer having translucency, each of the plurality of fluorescent sections being sealed by the first sealing layer and the second sealing layer in said step (c).

Advantageous Effects of Invention

As described above, a light source in accordance with the present invention includes: a plurality of fluorescent sections each emitting fluorescent light upon receipt of excitation light from an excitation light source; and a sealing member, having translucency, for sealing the plurality of fluorescent sections.

Further, a method for producing a light source in accordance with the present invention includes the steps of: (a) forming a first sealing layer having translucency; (b) forming, on the first sealing layer formed in said step (a), a plurality of fluorescent sections each emitting fluorescent light upon receipt of excitation light from an excitation light source; and (c) forming, on the plurality of fluorescent sections formed in said step (b), a second sealing layer having translucency, each of the plurality of fluorescent sections being sealed by the first sealing layer and the second sealing layer in said step (c).

It is therefore possible to (i) provide a light source having an airtight property and (ii) suppress deterioration of the plurality of the fluorescent sections.

BRIEF DESCRIPTION OF DRAWINGS

FIG. 1(*a*) is a perspective view illustrating the fluorescent material-sealed sheet; and FIG. 1(*b*) is a cross-sectional view illustrating the fluorescent material-sealed sheet.

FIG. 4(*a*) is a perspective view illustrating the another fluorescent material-sealed sheet; and FIG. 4(*b*) is a cross-sectional view illustrating the another fluorescent material-sealed sheet.

DESCRIPTION OF EMBODIMENTS

The following description will discuss, with reference to drawings, a fluorescent material-sealed sheet 1 of a present embodiment and the like. Note that, in the following description, identical members/components have their respective identical symbols. Therefore, such identical members/components have respective identical names and functions. Accordingly, their detailed descriptions will not be repeatedly provided.

Structure of Fluorescent Material-Sealed Sheet 1

Figure 1:
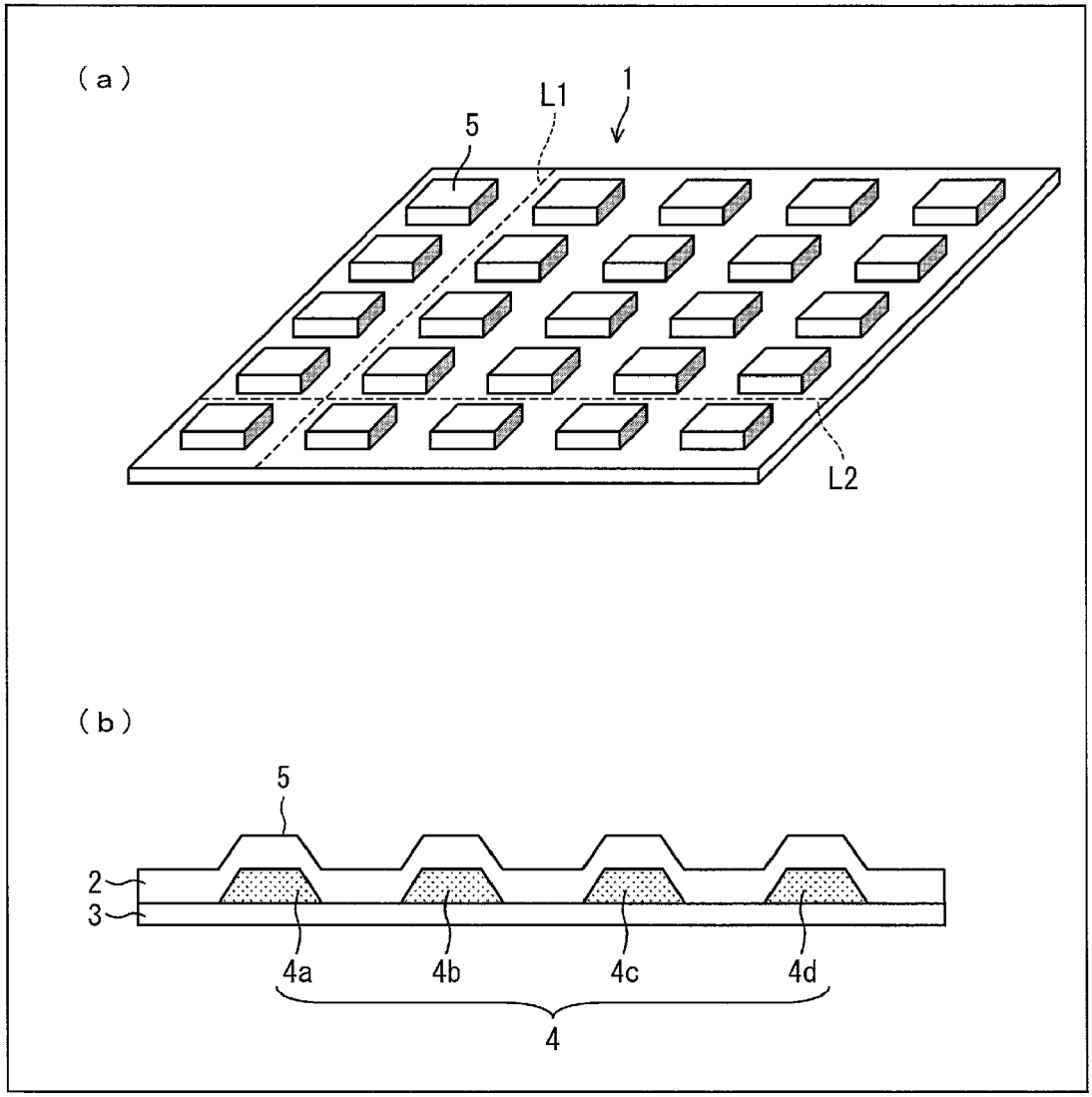
FIG. 1 is a view schematically illustrating a fluorescent material-sealed sheet in accordance with an embodiment of the present invention.

First, the following description will discuss a fluorescent material-sealed sheet (light source) 1 with reference to FIG. 1. FIG. 1 is a view schematically illustrating the fluorescent material-sealed sheet 1. FIG. 1(*a*) is a perspective view illustrating the fluorescent material-sealed sheet 1, and FIG. 1(*b*) is a cross-sectional view illustrating the fluorescent material-sealed sheet 1.

The fluorescent material-sealed sheet 1 is made up of an upper sealing section (sealing member) 2, a lower sealing section (sealing member) 3, and a fluorescent section 4. As illustrated in FIG. 1(*b*), the fluorescent section 4 is sealed by the upper sealing section 2 and the lower sealing section 3. The fluorescent section 4 is made up of fluorescent sections 4*a*, 4*b*, 4*c*, 4*d* . . . . The fluorescent sections 4*a*, 4*b*, 4*c*, 4*d* . . . are arranged apart from each other in a matrix manner. Hereinafter, the fluorescence sections 4*a*, 4*b*, 4*c*, 4*d* . . . are sometimes merely referred to as "fluorescent sections 4," in a case where it is unnecessary to distinguish the fluorescent sections 4*a*, 4*b*, 4*c*, 4*d* . . . from each other.

The fluorescent section 4 has a cross section of a trapezoid (convex) shape. Accordingly, the upper sealing section 2 has a plurality of convex parts 5 which (i) are apart from each other in a matrix manner and (ii) overlie the fluorescent section 4 along a shape of the fluorescent section 4 (see FIG. 1(*a*)). The plurality of convex parts 5 are arranged substantially in plane with each other so that they have identical uprising directions. Note that the fluorescent section 4 does not necessarily have a cross section of a trapezoid (convex) shape. The following description will deal with each of the sections of the fluorescent material-sealed sheet 1. The present embodiment has a configuration in which the fluorescent sections 4*a*, 4*b*, . . . are sealed by the upper sealing section 2 and the lower sealing section 3. Such a configuration is referred to as a "sheet".

Fluorescent Section 4

The fluorescent section 4 emits light upon receipt of excitation light from an excitation light source, such as a laser or an LED. The fluorescent section 4 contains a fluorescent material which emits light upon receipt of excitation light. More specifically, according to the fluorescent section 4, a fluorescent material is dispersed in a silicone resin serving as a fluorescent material retaining material. Note that it is preferable that a ratio of an amount of the silicone resin and an amount of the fluorescent material is, but not limited to, approximately 10:1. Alternatively, the fluorescent section 4 can be prepared by pressing and hardening a fluorescent material. The fluorescent material retaining material is not limited to the silicone resin, and can therefore be what is called organic-inorganic hybrid glass or inorganic glass.

The fluorescent section 4 is made from a material such as an oxynitride fluorescent material. A blue fluorescent material, a green fluorescent material, and a red fluorescent material are dispersed in a silicone resin. Note here that examples of the excitation light source which emits excitation light encompass a semiconductor light-emitting element. Examples of such a semiconductor light-emitting element encompass an LED which emits light having a wavelength of 450 nm (blue) and a "near-blue" LED or laser which emits light having a peak wavelength of not less than 440 nm but not more than 490 nm. Upon receipt of light from the LED, the fluorescent section 4 emits, for example, white light. That is, the fluorescent section 4 serves as a wavelength conversion material. In this case, the fluorescent section 4 is (i) a yellow fluorescent material or (ii) a mixture of a green fluorescent material and a red fluorescent material. Note that the yellow fluorescent material is a fluorescent material which emits light whose peak wavelength is not less than 560 nm but not more than 590 nm. The green fluorescent material is a fluorescent material which emits light whose peak wavelength is not less than 510 nm but not more than 560 nm. The red fluorescent material is a fluorescent material which emits light whose peak wavelength is not less than 600 nm but not more than 680 nm. Note, however, that a wavelength of light emitted from the semiconductor light-emitting element can be selected appropriately in accordance with a sort of the fluorescent section 4. Accordingly, it is possible to select a wavelength which is different from a wavelength of what is called "near-blue" light.

Further, examples of the excitation light source which emits excitation light encompass a light source which emits laser light whose wavelength is 405 nm (blue-violet). In this case, the fluorescent section 4 is the yellow fluorescent material or a mixture of the green fluorescent material and the red fluorescent material.

Further, the fluorescent section 4 can be made from what is called a sialon fluorescent material. Note that sialon is a substance obtained by substituting, in silicon nitride ($Si_3N_4$), (i) a part of silicon atoms with aluminum atoms and (ii) a part of nitrogen atoms with oxygen atoms. The sialon fluorescent material can be prepared by obtaining a solid solution of silicon nitride, alumina ($Al_2O_3$), silica ($SiO_2$), a rare-earth element, and the like.

Alternatively, it is possible to employ, as another suitable example of the fluorescent section 4, a semiconductor nanoparticle fluorescent material in which nanometer-size particles of a III-V group compound semiconductor are used. One of features of the semiconductor nanoparticle fluorescent material resides in that, even in a case where compound semiconductors (for example, indium phosphide: InP) having identical compositions are employed, it is possible to change a color of light emitted from the semiconductor nanoparticle fluorescent material. This is because of quantum size effect caused by changing particle sizes of the compound semiconductors. The fluorescent section 4 emits red light, for example, in a case where compound semiconductors InP whose particle sizes fall within a range of approximately 3 nm to approximately 4 nm are employed.

The semiconductor nanoparticle fluorescent material also has features in which (i) a fluorescence lifetime is short because the semiconductor nanoparticle fluorescent material is a semiconductor-based one and (ii) the semiconductor nanoparticle fluorescent material is highly resistant to high-power excitation light because the semiconductor nanoparticle fluorescent material can emit quickly, as fluorescent light, excitation energy which is absorbed from the excitation light. This is because of the fact that an emission lifetime of the semiconductor nanoparticle fluorescent material is approximately 10 nanoseconds, and this emission lifetime is shorter by 5 orders of magnitude than that of a general fluorescent material in which a rare-earth element serves as an emission center.

Since the use of the semiconductor nanoparticle fluorescent material makes it possible to maintain high efficiency with respect to high-power excitation light, heat generated by the fluorescent material is reduced. It is therefore possible to suppress deterioration (discoloration and/or deformation) due to heat generated by the fluorescent section. This allows a lifetime of a light-emitting device to be prevented from becoming short, in a case where a light-emitting element having a high-power optical output is employed as a light source.

The fluorescent section 4 is not limited to a specific one, and can be therefore selected as appropriate.

Upper Sealing Section 2 and Lower Sealing Section 3

The fluorescent section 4 is sealed by the upper sealing section 2 and the lower sealing section 3, each of which is made from a translucent material. A resin material having translucency, i.e., an amorphous resin, is employed as the translucent material. Suitable examples of such a resin material encompass: polystyrene; acrylonitrile/styrene; an acrylonitrile/butadiene/styrene resin; a methacrylic resin; and vinyl chloride. Alternatively, a glass material can be employed as the translucent material, for example. It is preferable that a sealing material be high in translucency. In a case where excitation light is high-energy light (a high-power optical output), like a laser beam, it is preferable that the lower sealing section 3 and the like have a high heat-resistance property. In a case where a fluorescent material which is vulnerable to water or oxygen is employed, it is possible for the fluorescent material to have an increase in resistance with respect to water and oxygen, by sealing the fluorescent material with the sealing material.

Use of Fluorescent Material-Sealed Sheet 1

The upper sealing section 2 has a plurality of convex parts 5 which are arranged so as to (i) overlie the respective plurality of fluorescent sections 4 along the respective shapes of the plurality of fluorescent sections 4 and (ii) be apart from each other in a matrix manner. Note here that the upper sealing section 2 and the lower sealing section 3 can be formed integral with each other (serving as a single sealing section). In this case, the fluorescent sections 4*a*, 4*b*, 4*c*, 4*d* . . . are sealed by such a single sealing section.

Figure 2:
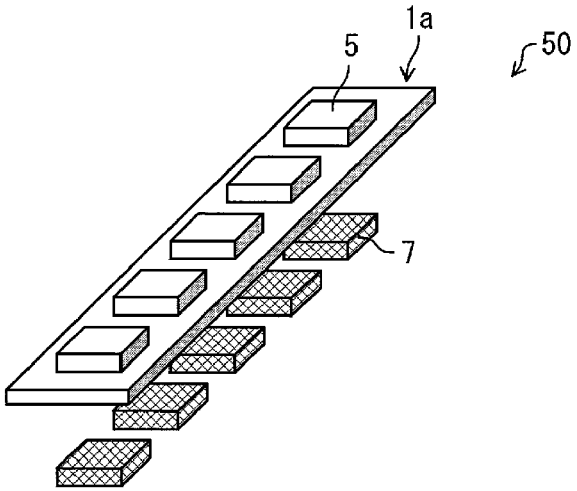
FIG. 2 is a perspective view illustrating a one-dimensional light-emitting device which employs a one-dimensional light-emitting light source in accordance with the present embodiment.
Figure 3:
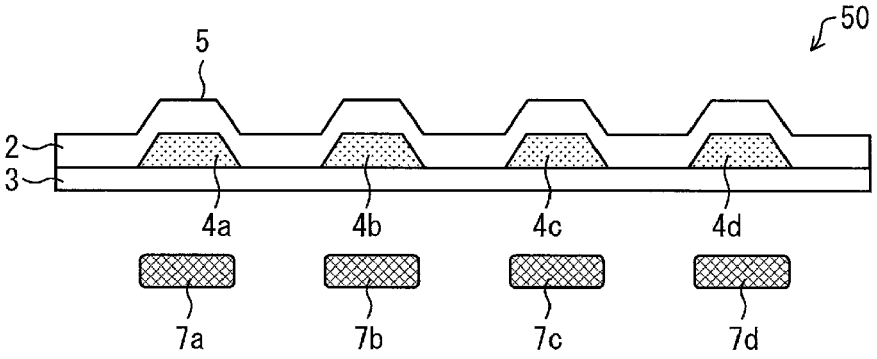
FIG. 3 is a cross-sectional view illustrating the one-dimensional light emitting device in accordance with the present embodiment.

FIG. 2 and the like illustrate an arrangement of a divided light source (one-dimensional light-emitting light source 1*a*), which can be obtained by cutting the fluorescent material-sealed sheet 1 along a dotted line (L1 or L2) shown in FIG. 1(*a*). FIG. 2 is a perspective view illustrating a one-dimensional light-emitting device 50 which employs the one-dimensional light-emitting light source 1*a*. FIG. 3 is a cross-sectional view illustrating the one-dimensional light-emitting device 50. Note here that, in the fluorescent material-sealed sheet 1, no fluorescent section is present either (i) directly below the dotted lines L1 and L2 and (ii) in the vicinity of areas directly below the dotted lines L1 and L2.

The one-dimensional light-emitting light source 1*a* is a light source obtained in a case where the fluorescent material-sealed sheet 1 illustrated in FIG. 1 is cut along the dotted line L1 (or the dotted line L2). Accordingly, the one-dimensional light-emitting light source 1*a* has a cross section which is similar to that of the fluorescent material-sealed sheet 1 (illustrated in FIG. 1(*b*)). The one-dimensional light-emitting device 50 can be obtained by (i) thus cutting the one-dimensional light-emitting light source 1*a* out of the fluorescent material-sealed sheet 1 and then (ii) combining the one-dimensional light-emitting light source 1*a* thus cut out and LED chips.

More specifically, the one-dimensional light-emitting device 50 has an arrangement in which a plurality of LED chips 7 are provided to face a first surface of the one-dimensional light-emitting light source 1*a*, which first surface is opposite to a second surface on which the respective plurality of convex parts 5 are formed (see FIG. 3). The plurality of LED chips 7 are provided so as to be away, by a certain distance, from the one-dimensional light-emitting light source 1*a*. Note here that the plurality of LED chips 7 are arranged for the respective fluorescent sections 4. That is, LED chips 7*a*, 7*b*, 7*c*, 7*d* . . . are arranged for the fluorescent sections 4*a*, 4*b*, 4*c*, 4*d* . . . , respectively. In other words, according to the fluorescent material-sealed sheet 1, the fluorescent sections 4*a*, 4*b*, 4*c*, 4*d* . . . are subjected to positioning so as to be arranged for the LED chips 7*a*, 7*b*, 7*c*, 7*d* . . . , respectively.

Note that the fluorescent section 4 has a cross section of a trapezoid shape whose width is narrower on a convex part 5 side (see FIG. 3). This allows an improvement in light-emitting efficiency of the one-dimensional light-emitting device 50. This is because of the fact that (i) part of light emitted from the LED chip 7 is converted into fluorescent light by the fluorescent section 4, (ii) a reflection loss can be suppressed which is generated when the fluorescent light is reflected from the sealing member while being directed toward outside, and (iii) such suppression causes an increase in amount of fluorescent light emitted from the fluorescent section 4.

With the arrangement, it is possible to prevent the fluorescent light, generated by the fluorescent section 4, from propagating crosswise (propagating toward an adjacent fluorescent section). This allows an improvement in light-emitting efficiency of the one-dimensional light-emitting device 50.

Note that the cross section of the fluorescent section 4 is not limited to the trapezoid shape illustrated in FIG. 3, provided that the fluorescent section 4 has a cross section whose width is narrower on a convex part 5 side.

Each of the fluorescent sections 4*a*, 4*b*, 4*c*, 4*d* . . . is sealed by the upper sealing section 2 and the lower sealing section 3. With the arrangement, a fluorescent section 4 can be handled in a sealed manner without being exposed to the air even if the fluorescent material-sealed sheet 1 is cut along the dotted line L1 (or the dotted line L2). According to the one-dimensional light-emitting light source 1*a*, it is possible to prevent deterioration of the fluorescent section 4 due to the fluorescent section 4 being exposed to the air before and after the one-dimensional light-emitting light source 1*a* is cut off from the fluorescent material-sealed sheet 1. This effect is marked particularly in a case where the fluorescent section 4 contains a fluorescent material having a characteristic in which the fluorescent material is easily deteriorated while being exposed to the air.

Method for Preparing Fluorescent Material-Sealed Sheet 1

The following description will discuss a method for preparing the fluorescent material-sealed sheet 1.

First, a lower sealing section 3, which has translucency, is formed (first forming step). Next, on the lower sealing section 3 formed in the first forming step, fluorescent sections 4*a*, 4*b*, 4*c*, 4*d* . . . , each of which emits fluorescent light upon receipt of excitation light from an excitation light source, are formed (second forming step). Note that the fluorescent sections 4*a*, 4*b*, 4*c*, 4*d* . . . are formed apart from each other in a matrix manner. Then, an upper sealing section 2, which has translucency, is formed on the fluorescent sections 4*a*, 4*b*, 4*c*, 4*d* . . . , formed in the second forming step (third forming step). In the third forming step, the fluorescent sections 4*a*, 4*b*, 4*c*, 4*d* . . . are sealed by the upper sealing section 2 and the lower sealing section 3.

The fluorescent material-sealed sheet 1 is thus prepared. Note that the method for preparing the fluorescent material-sealed sheet 1 has been described above. Note, however, that the method can be also similarly employed for preparation of a fluorescent material-sealed sheet 10 and the like (later described).

Structure of Fluorescent Material-Sealed Sheet 10

Figure 4:
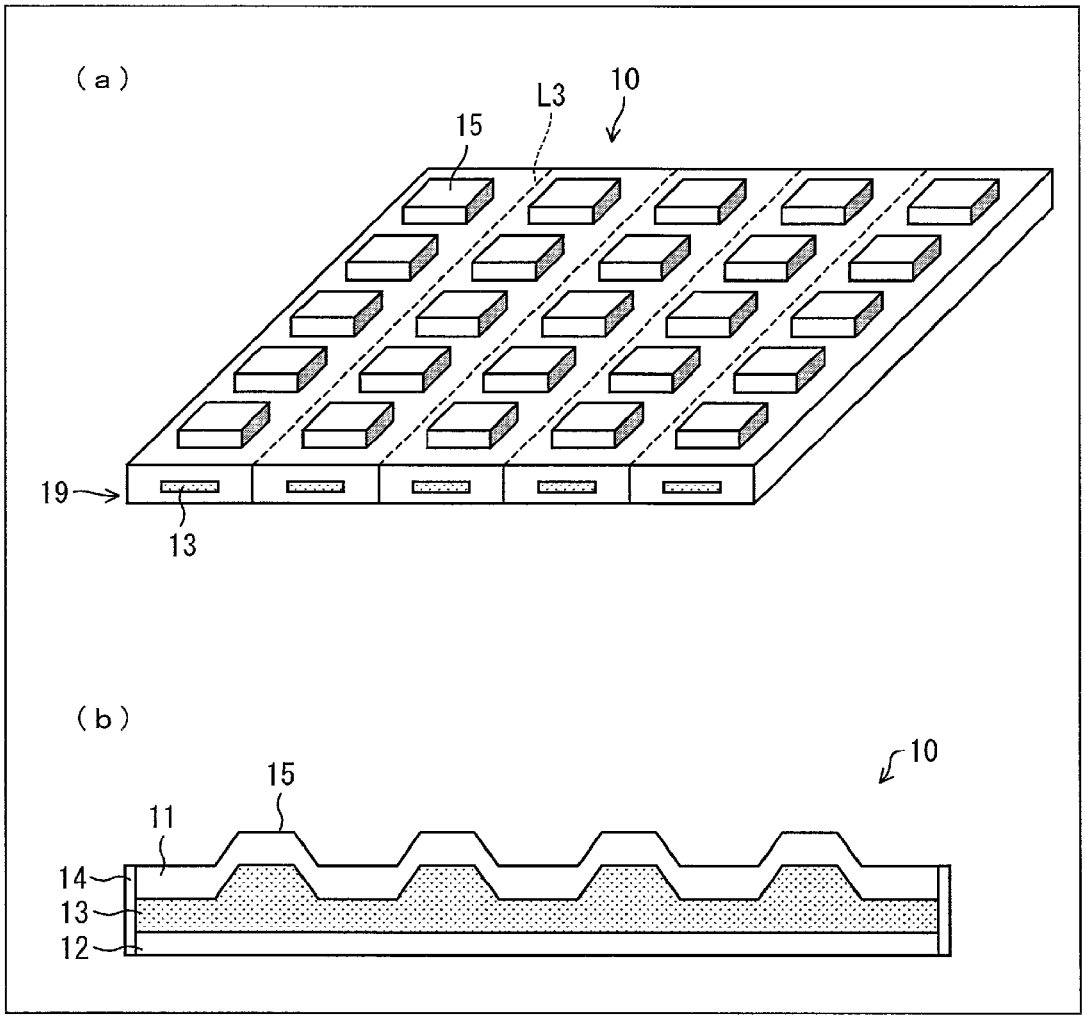
FIG. 4 is a view schematically illustrating another fluorescent material-sealed sheet in accordance with the present embodiment.

Next, the following description will discuss a fluorescent material-sealed sheet 10 in accordance with the present embodiment, with reference to FIG. 4 and other drawings. FIG. 4 is a view schematically illustrating the fluorescent material-sealed sheet 10. FIG. 4 (*a*) is a perspective view illustrating the fluorescent material-sealed sheet 10. FIG. 4 (*b*) is a cross-sectional view illustrating the fluorescent material-sealed sheet 10. Note that description of a content which is identical with the content described with reference to FIG. 1 and the like is omitted here for the sake of simple explanation. This also applies to description of a fluorescent material-sealed sheet 20 and the like (later described).

As illustrated in FIG. 4(*b*), the fluorescent material-sealed sheet 10 is made up of an upper sealing section 11, a lower sealing section 12, and a fluorescent section 13. The fluorescent section 13 has a layer shape, and is sealed by the upper sealing section 11 and the lower sealing section 12. The fluorescent section 13 has convex parts provided in a regular manner, and the convex parts each have a cross section of a trapezoid shape. Accordingly, as illustrated in FIG. 4(*a*), the upper sealing section 11 has a plurality of convex parts 15 which are arranged so as to (i) overlie the respective plurality of fluorescent sections 13 along the convex parts of the respective plurality of fluorescent sections 13 and (ii) be apart from each other in a matrix manner.

Note that the fluorescent material-sealed sheet 10 illustrated in FIG. 4(*b*) has an arrangement in which the fluorescent section 13 is sealed, at both ends (an end on the right side and an end on the left side in FIG. 4(*b*)) of the fluorescent material-sealed sheet 10, by the upper sealing section 11, the lower sealing section 12, and a sealing member 14. Note, however, that the sealing of the fluorescent section 13 is not limited to this. Alternatively, the fluorescent section 13 is sealed by the upper sealing section 11 and the lower sealing section 12, without using the sealing member 14.

Use of Fluorescent Material-Sealed Sheet 10

The upper sealing section 11 has the plurality of convex parts 15 which are arranged so as to (i) overlie the respective fluorescent sections 13 along the convex parts of the respective plurality of fluorescent sections 13 and (ii) be apart from each other in a matrix manner.

Figure 5:
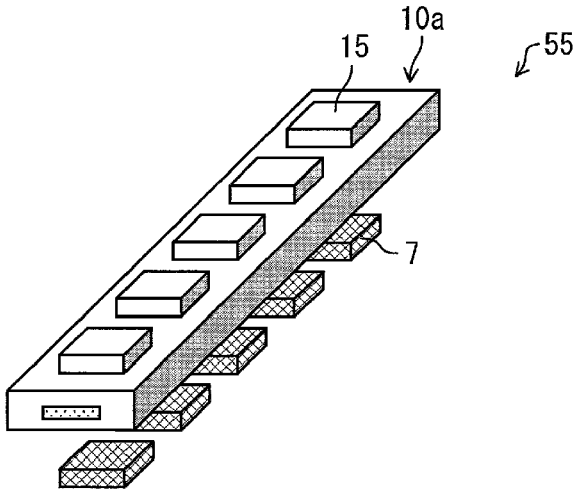
FIG. 5 is a perspective view illustrating another one-dimensional light-emitting device which employs the another one-dimensional light-emitting light source in accordance with the present embodiment.
Figure 6:
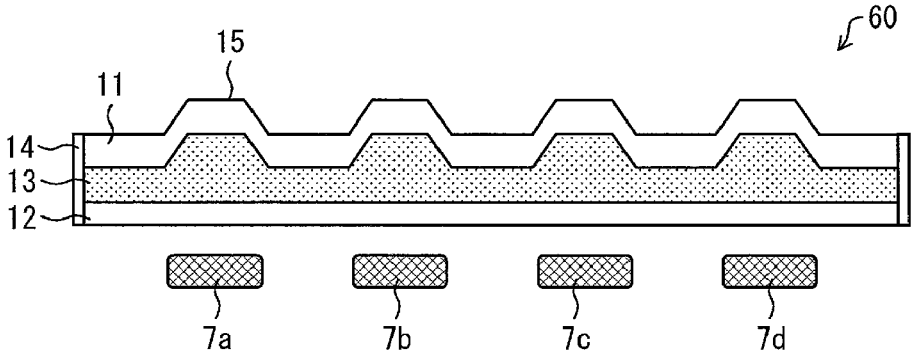
FIG. 6 is a cross-sectional view illustrating the another one-dimensional light-emitting device in accordance with the present embodiment.

With the arrangement, a divided light source (a one-dimensional light-emitting light source 10*a*) can be obtained by cutting the fluorescent substance sealing sheet 10 along a dotted line (L3) shown in (a) of FIG. 4. A structure of the one-dimensional light-emitting light source 10*a* is illustrated in FIG. 5 and other drawings. FIG. 5 is a perspective view illustrating a one-dimensional light-emitting device 55 which employs the one-dimensional light-emitting light source 10*a*. FIG. 6 is a cross-sectional view illustrating the one-dimensional light-emitting device 55.

The one-dimensional light-emitting light source 10*a* is a light source which can be obtained by cutting, along the dotted line L3, the fluorescent substance sealing sheet 10 illustrated in FIG. 4. Accordingly, the one-dimensional light-emitting light source 10*a* has a cross section whose shape is similar to that of the fluorescent material-sealed sheet 10 (see (b) of FIG. 4). As described above, it is possible to obtain the one-dimensional light-emitting device 55 by (i) cutting out the one-dimensional light-emitting light source 10*a* from the fluorescent material-sealed sheet 10 and (ii) combining the one-dimensional light-emitting light source 10*a* with LED chips.

Note that it is also possible to divide the fluorescent material-sealed sheet 10 along a direction perpendicular to the dotted line L3. In this case, since part of the fluorescent section 13 is, however, exposed to the air, deterioration of the fluorescent sections 13 is likely to be hastened. In view of the circumstances, it is preferable to obtain the one-dimensional light-emitting device 55 from the one-dimensional light-emitting light source 10*a* by dividing the fluorescent material-sealed sheet 10 along the dotted line L3.

Note here that, since the fluorescent section 13 of the fluorescent material-sealed sheet 10 has a layer shape, the fluorescent material-sealed sheet 10 can be prepared easily, as compared with the fluorescent material-sealed sheet 1. Meanwhile, the fluorescent material-sealed sheet 1 is superior to the fluorescent material-sealed sheet 10 in that a one-dimensional light-emitting light source can be obtained by cutting the fluorescent material-sealed sheet 1 along one of two directions, i.e. along the dotted line L1 or L2, unlike the fluorescent material-sealed sheet 10 which is preferably cut along only one direction. Furthermore, since the fluorescent material-sealed sheet 1 is configured such that the plurality of fluorescent sections 4 are formed in a matrix manner, it is possible to reduce a volume of the plurality of fluorescent sections used in the fluorescent material-sealed sheet 1, in comparison with the fluorescent material-sealed sheet 10 in which the fluorescent section 13 is formed to have a layer shape.

Note that another example fluorescent material-sealed sheet can be employed which has an arrangement similar to that of the fluorescent material-sealed sheet 10. According to such another example, (i) an upper sealing section 11 has convex parts while a fluorescent section 13 has no convex part, and (ii) the convex parts are arranged substantially in plane with each other so that they have identical uprising directions. With the arrangement, since the upper sealing section 11 has the convex parts, it is possible to efficiently extract light in a direction in which the convex parts of the upper sealing section 11 rise up, even if the fluorescent section 13 has no convex parts.

Structure of Fluorescent Material-Sealed Sheet 20

Figure 7:
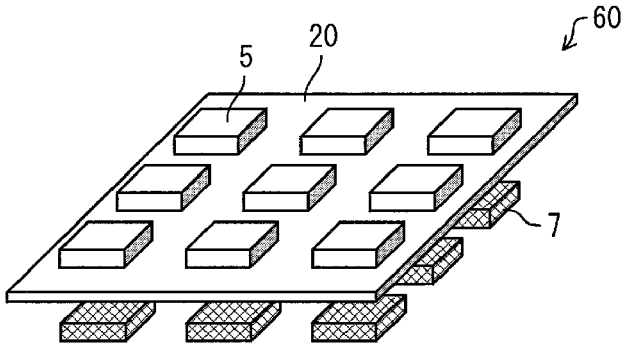
FIG. 7 is a view schematically illustrating (i) another fluorescent material-sealed sheet in accordance with the present embodiment and (ii) a two-dimensional light-emitting device which employs the another fluorescent material-sealed sheet.

Next, the following description will discuss, with reference to FIG. 7, (i) a fluorescent material-sealed sheet 20 in accordance with the present embodiment and (ii) a two-dimensional light-emitting device 60 which employs the fluorescent material-sealed sheet 20. FIG. 7 is a view schematically illustrating the fluorescent material-sealed sheet 20 and the two-dimensional light-emitting device 60 which employs the fluorescent material-sealed sheet 20.

The two-dimensional light-emitting device 60 is made up of the fluorescent material-sealed sheet 20 and a plurality of LED chips 7. Note that the fluorescent material-sealed sheet 20 can have an arrangement similar to that of the fluorescent material-sealed sheet 1 or that of the fluorescent material-sealed sheet 10. Accordingly, the plurality of LED chips 7 are arranged for the respective fluorescent sections 4*a*, 4*b*, 4*c*, 4*d* . . . , described with reference to FIG. 1.

The two-dimensional light-emitting device 60 has a feature that the fluorescent material-sealed sheet 20 is used as a light source without being divided (cut out). For this reason, according to the fluorescent material-sealed sheet 20, a plurality of convex parts 5 are arranged in two directions which are perpendicular to each other (such a light source is referred to as "two-dimensional light source" in some cases), unlike the one-dimensional light-emitting light source 1*a* in which the plurality of convex parts 5 are aligned only in one direction.

Note that the fluorescent material-sealed sheet 20 can be obtained, for example, by cutting off at least one of one-dimensional light-emitting devices from the fluorescent material-sealed sheet 1.

Structures of Fluorescent Material-Sealed Sheet 30 and Fluorescent Material-Sealed Sheet 40

Figure 8:
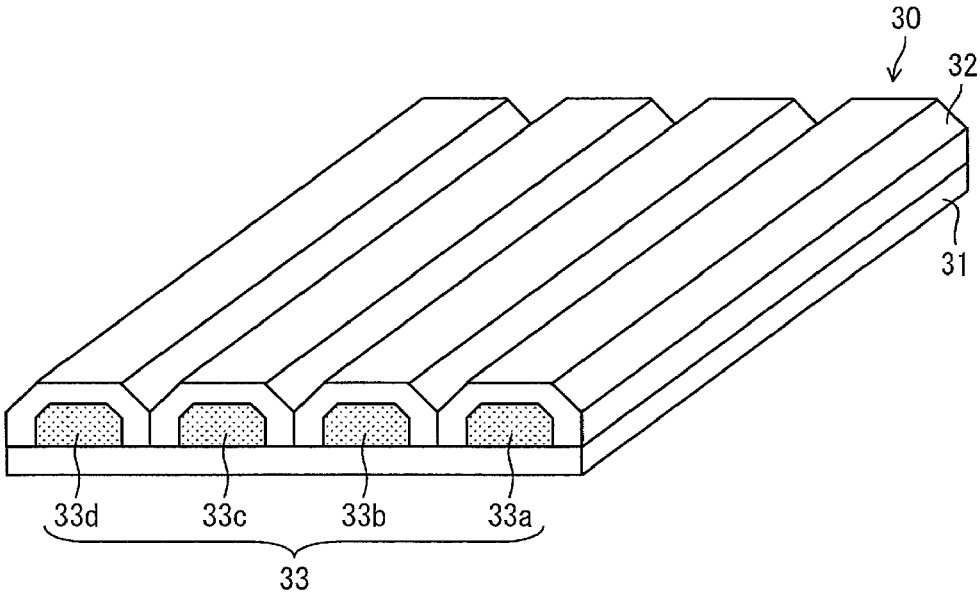
FIG. 8 is a perspective view illustrating another fluorescent material-sealed sheet in accordance with the present embodiment.

Next, the following description will discuss a fluorescent material-sealed sheet 30 in accordance with the present embodiment, with reference to FIG. 8. FIG. 8 is a perspective view illustrating the fluorescent material-sealed sheet 30.

As illustrated in FIG. 8, the fluorescent material-sealed sheet 30 is made up of a lower sealing section 31, an upper sealing section 32, and fluorescent sections 33*a*, 33*b*, 33*c*, and 33*d*. Hereinafter, the fluorescent sections 33*a*, 33*b*, 33*c*, and 33*d* are merely sometimes referred to as "fluorescent sections 33", in a case where it is unnecessary to distinguish the fluorescent sections 33*a*, 33*b*, 33*c*, and 33*d* from each other.

Each of the fluorescent sections 33*a*, 33*b*, 33*c*, and 33*d* is formed on the lower sealing section 31 to have a layer shape, and has a cross section of a trapezoid shape. In other words, the fluorescent sections 33*a*, 33*b*, 33*c*, and 33*d* have respective convex shapes, and are provided on the lower sealing section 31 so that they have identical uprising directions.

With the structure, it is also possible to (i) cut the fluorescent material-sealed sheet 30 along a line between each of the fluorescent sections 33*a*, 33*b*, 33*c*, and 33*d* shown in FIG. 8 and (ii) use, as one-dimensional light-emitting devices, individual divided fluorescent material-sealed sheets.

In this case, since each of the fluorescent sections 33*a*, 33*b*, 33*c*, and 33*d* is sealed by the lower sealing section 31 and the upper sealing section 32, each of the fluorescent sections 33 can be handled in a sealed manner without being exposed to the air, even if the fluorescent material-sealed sheet 30 is cut along the line between each of the fluorescent sections 33*a*, 33*b*, 33*c*, and 33*d*. This makes it possible to prevent deterioration of the fluorescent section 33 due to the fluorescent section 33 being exposed to the air before and after the one-dimensional light-emitting light source is cut off from the fluorescent material-sealed sheet 60. This effect is marked particularly in a case where the fluorescent section 33 contains a semiconductor nanoparticle fluorescent material having a characteristic in which the fluorescent material is easily deteriorated while being exposed to the air. Further, the fluorescent section 33 has a cross-section of a trapezoid shape whose width becomes narrower gradually in the uprising direction (see FIG. 8). This allows an improvement in light-emitting efficiency of the one-dimensional light-emitting device. This is because of the fact that (i) light is emitted from the LED chip to the fluorescent section 33, (ii) a reflection loss can be suppressed which is generated when the light is reflected from the fluorescent section 33, and (iii) such suppression causes an increase in amount of fluorescent light emitted from the fluorescent section 33. These effects also can be obtained with a fluorescent material-sealed sheet 40 (later described).

FIG. 8 illustrates the fluorescent material-sealed sheet 30 which is made up of four fluorescent sections 33*a*, 33*b*, 33*c*, and 33*d*. Note, however, that the number of fluorescent sections 33 is not limited particularly. This also applies to a fluorescence substance sealing sheet 40 which will be described later with reference to FIG. 9.

Figure 9:
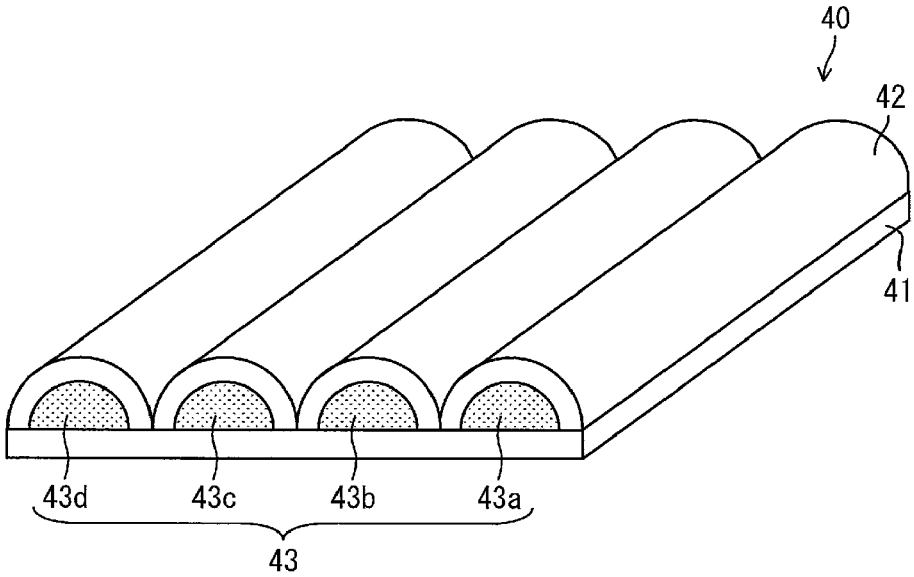
FIG. 9 is a perspective view illustrating another fluorescent material-sealed sheet in accordance with the present embodiment.

The following description will discuss a fluorescent material-sealed sheet 40 in accordance with the present invention, with reference to FIG. 9. FIG. 9 is a perspective view illustrating the fluorescent material-sealed sheet 40.

As illustrated in FIG. 9, the fluorescent material-sealed sheet 40 includes a lower sealing section 41, an upper sealing section 42, and fluorescent sections 43*a*, 43*b*, 43*c*, and 43*d*. Hereinafter, the fluorescent sections 43*a*, 43*b*, 43*c*, and 43*d* are sometimes merely referred to as "fluorescent sections 43" in a case where it is unnecessary to distinguish the fluorescent sections 43*a*, 43*b*, 43*c*, and 43*d* from each other.

Each of the fluorescent sections 43*a*, 43*b*, 43*c*, and 43*d* is formed on the lower sealing section 41 so as to have a layer shape. The fluorescent section 43 has a cross-section of a semicircular shape. In other words, the fluorescent sections 43*a*, 43*b*, 43*c*, and 43*d* are formed to have respective convex shapes on the lower sealing part 41 so that they have identical uprising directions. The fluorescent section 43 is sealed by the lower sealing section 41 and the upper sealing section 42.

With the arrangement, it is also possible to (i) cut the fluorescent material-sealed sheet 40 along a line between each of the fluorescent sections 43*a*, 43*b*, 43*c*, and 43*d* shown in FIG. 9 and (ii) provide, as one-dimensional light-emitting devices, individual divided fluorescent material-sealed sheets 40.

The fluorescent section can have various shapes, and can bring about the aforementioned respective various effects, accordingly.

Other Applicable Examples

Figure 10:
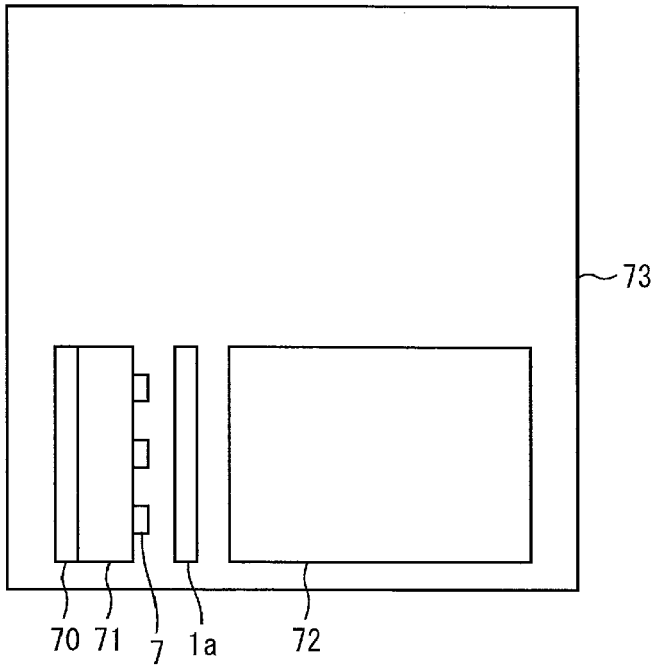
FIG. 10 is a view schematically illustrating how the one-dimensional light-emitting light source in accordance with the present embodiment is used as a light source for a backlight of a display device.

It is possible to employ, as a light source for a backlight of a liquid crystal display device, a one-dimensional light-emitting light source 1*a* and the like (or a fluorescent material-sealed sheet 1 and the like) in accordance with the present embodiment. This will be described with reference to FIG. 10. FIG. 10 is a view schematically illustrating how the one-dimensional light-emitting light source 1*a* (or the fluorescent material-sealed sheet 1) is used as a light source for a backlight of a liquid crystal display device 73. Note that the following description will deal with a case where the one-dimensional light-emitting light source 1*a* (or the fluorescent material-sealed sheet 1) is employed. Note, however, that it is possible to employ, as the light source, the foregoing one-dimensional light-emitting light source 10*a* or the foregoing fluorescent material-sealed sheet 10, for example, in place of the one-dimensional light-emitting light source 1*a* (or the fluorescent material-sealed sheet 1).

As illustrated in FIG. 10, the display device 73 is made up of a plurality of LED chips 7, the one-dimensional light-emitting light source 1*a*, a circuit substrate 70, a substrate 71, and a light guide plate 72.

The plurality of LED chips 7 are provided on one of surfaces of the substrate 71. The circuit substrate 70 and electrodes (not illustrated) connected to the circuit substrate 70 are provided on the other one of the surfaces of the substrate 71.

The display device 73 employs, as a light source for a backlight, an LED module in which (i) the plurality of LED chips 7 are provided at certain intervals on the substrate 71 having a rectangular shape and (ii) the one-dimensional light-emitting light source 1*a* is provided so as to face the plurality of LED chips 7. Light, which has been emitted from the one-dimensional light-emitting light source 1*a* and has entered the light guide plate 72, is subjected to, inside the light guide plate 72, total reflection, scattering, and/or the like so as to be directed toward a light-exit surface of the light guide plate 72. According to the display device 73, the LED module is provided a certain distance away from the light guide plate 72 so that light which is uniform in characteristics reaches a side surface of the light guide plate 72.

Note that the display device 73 can be alternatively configured by a configuration in which the fluorescent material-sealed sheet 1 or the like is employed instead of the one-dimensional light-emitting light source 1*a*.

Note also that a direction in which light, that has been emitted from the one-dimensional light-emitting light source 1*a* and has entered the light guide plate 72, is not limited to a direction shown in FIG. 10. Such a direction can be any direction. For example, the light can enter the light guide plate 72 from two sides of the display device 73, opposite to each other, or from all of four sides of the display device 73.

Other Examples of LED

Figure 11:
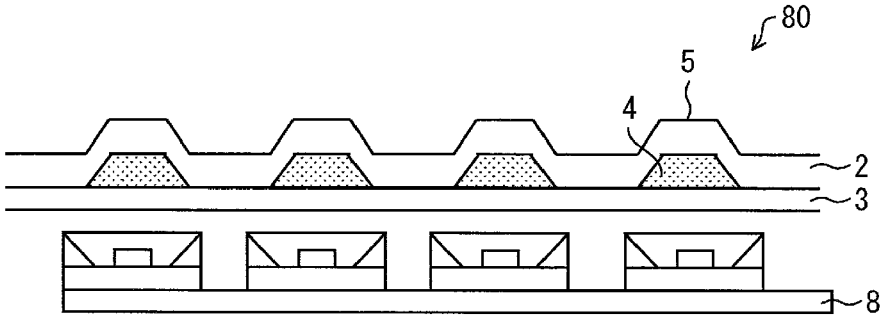
FIG. 11 is a cross-sectional view illustrating another one-dimensional light-emitting device in accordance with the present embodiment.
Figure 12:
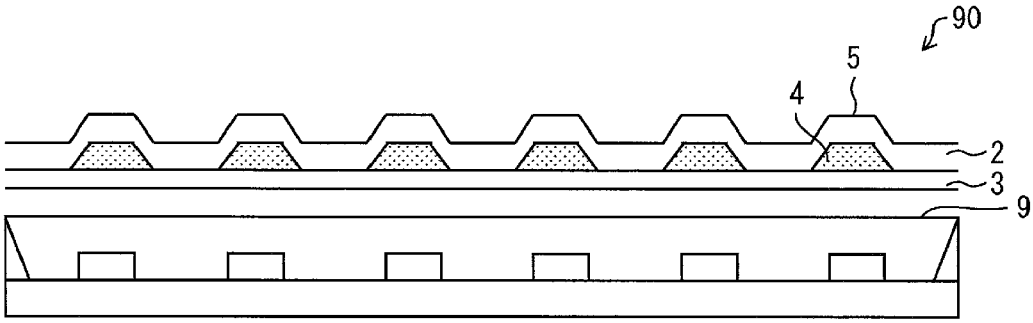
FIG. 12 is a cross-sectional view illustrating another one-dimensional light-emitting device in accordance with the present embodiment.

The following description will discuss, with reference to FIGS. 11 and 12, other examples of an LED which can be employed in the present embodiment.

FIG. 11 is a cross-sectional view illustrating a one-dimensional light-emitting device 80. The one-dimensional light-emitting device 80 is made up of a fluorescent material-sealed sheet 1 illustrated in FIG. 1(*b*) and a plurality of LED elements 8 each of which is sealed with a translucent resin having a cup shape. Each of the plurality of LED elements 8 emits light toward a corresponding one of fluorescent sections 4.

FIG. 12 is a cross-sectional view illustrating a one-dimensional light-emitting device 90. The one-dimensional light-emitting device 90 is made up of a fluorescent material-sealed sheet 1 illustrated in FIG. 1(*b*) and a plurality of LED elements 9 which (i) are sealed in a lump with a translucent resin and (ii) are arranged at certain intervals. In this case, each of the plurality of LED elements 9 also emits light toward a corresponding one of fluorescent sections 4.

LED elements of various types can be thus used with a one-dimensional light-emitting device (or a two-dimensional light-emitting device) in accordance with the present embodiment. Similarly, excitation light sources of various types (such as a laser) can be also used with the one-dimensional light-emitting device (or the two-dimensional light-emitting device) in accordance with the present embodiment.

Others

A light-emitting device in accordance with the present embodiment can be configured such that a fluorescent material layer in which a fluorescent material is dispersed is sealed by an upper sealing member and a lower sealing member, each of which has translucency, the fluorescent material emitting light other than blue light by being excited with light emitted from a blue light-emitting element.

The light-emitting device in accordance with the present embodiment can be configured such that the fluorescent material layer is divided into a plurality of parts by the upper sealing member and the lower sealing member.

The light-emitting device in accordance with the present embodiment can be configured such that the fluorescent substance layer is divided into a plurality of parts by the upper sealing member and the lower sealing member so that the plurality of parts of the fluorescent material layer have linear shapes, respectively.

The light-emitting device in accordance with the present embodiment can be such that the plurality of parts of the fluorescent material layer, having the linear shapes, respectively, are sealed by the upper sealing member and the lower sealing member, and one of the upper sealing member and the lower sealing member has a surface having a convex shape.

The light-emitting device in accordance with the present embodiment can be configured such that the fluorescent material layer is divided into a plurality of parts by the upper sealing member and the lower sealing member so as to (i) have dot shapes, respectively, and (ii) be arranged in a regular pattern.

The light-emitting device in accordance with the present embodiment can be configured such that the fluorescent material included in the fluorescent material layer is a semiconductor nanoparticle fluorescent material.

The light-emitting device in accordance with the present embodiment can include at least one blue light-emitting element, sealing members which have translucency, and a fluorescent material sheet provided between the sealing members, the fluorescent material sheet including a fluorescent material layer in which a fluorescent material is dispersed, the fluorescent material emitting light other than blue light by being excited with light emitted from the at least one blue light-emitting element.

The light-emitting device in accordance with the present embodiment can be configured such that the at least one blue light-emitting element is at least one semiconductor light-emitting diode element or at least one semiconductor laser diode element.

The light-emitting device in accordance with the present embodiment can be configured such that the at least one blue light-emitting element includes a plurality of blue light-emitting elements, and the plurality of blue light-emitting elements are provided on a substrate so as to be arranged linearly.

Embodiments of a fluorescent material-sealed sheet 1 are as described above. These embodiments solely indicate examples of the present embodiment, and, as a matter of course, it is possible to combine the foregoing embodiments with each other.

In order to attain the object, a light source in accordance with one embodiment of the present invention includes: a plurality of fluorescent sections each emitting fluorescent light upon receipt of excitation light from an excitation light source; and a sealing member, having translucency, for sealing the plurality of fluorescent sections.

In order to attain the object, a method for producing a light source in accordance with one embodiment of the present invention includes the steps of: (a) forming a first sealing layer having translucency; (b) forming, on the first sealing layer formed in said step (a), a plurality of fluorescent sections each emitting fluorescent light upon receipt of excitation light from an excitation light source; and (c) forming, on the plurality of fluorescent sections formed in said step (b), a second sealing layer having translucency, each of the plurality of fluorescent sections being sealed by the first sealing layer and the second sealing layer in said step (c).

According to the above arrangement, each of the plurality of fluorescent sections is sealed by the sealing member. Accordingly, it is possible to (i) cut out each of the plurality of fluorescent sections while keeping each of the plurality of fluorescent sections in a sealed state, and (ii) use each of the plurality of fluorescent sections as an individual light source. Here, since each of the plurality of fluorescent sections is sealed by the sealing member, each of the plurality of fluorescent sections can retain its airtight property. It is therefore possible to suppress deterioration of each of the plurality of fluorescent sections.

Further, the light source in accordance with the embodiment of the present invention is configured such that each of the plurality of fluorescent sections is sealed by the sealing member. Accordingly, it is possible to change (adjust) a shape and/or a size of the light source easily and flexibly by (i) changing a shape and/or a size of each of the plurality of fluorescent sections and (ii) sealing each of the plurality of fluorescent sections.

Further, the method for producing a light source in accordance with the embodiment of the present invention includes the steps (a) through (c) described above. Accordingly, it is possible to (i) cut out each of the plurality of fluorescent sections and (ii) use each of the plurality of fluorescent sections independently. Moreover, since each of the plurality of fluorescent sections is sealed by the sealing member, each of the plurality of fluorescent sections can retain its airtight property. It is therefore possible to suppress deterioration of each of the plurality of fluorescent sections.

Further, the light source in accordance with one embodiment of the present invention can be arranged such that at least two of the plurality of fluorescent sections have respective convex shapes; and said at least two of the plurality of fluorescent sections are arranged substantially in plane with each other so that uprising directions of the respective convex shapes are identical to each other.

With the arrangement, the light source in accordance with the embodiment of the present invention is configured such that at least two of the plurality of fluorescent sections have respective convex shapes. Since the at least two of the plurality of fluorescent sections have respective convex shapes, fluorescent light emitted from the at least two of the plurality of fluorescent sections is unlikely to propagate in a direction perpendicular to the uprising direction of the at least two of the plurality of fluorescent sections. This makes it possible to have an increase in a ratio of fluorescent light extracted in the uprising direction of the at least two of the plurality of fluorescent sections. For this reason, according to the light source of the embodiment of the present invention, it is possible to (i) improve efficiency in extracting the fluorescent light in the uprising direction of the at least two of the plurality of fluorescent sections, and therefore (ii) improve light-emitting efficiency of the light source.

Note that, by arranging the at least two of the plurality of fluorescent sections substantially in plane with each other so that uprising directions of the respective convex shapes are identical with each other, it is possible to improve, as much as possible, efficiency in extracting the fluorescent light in the uprising direction of the at least two of the plurality of fluorescent sections, in a case where the at least two of the plurality of fluorescent sections are cut out and used as individual light sources. Further, by arranging the at least two of the plurality of fluorescent sections substantially in plane with each other so that uprising directions of the respective convex shapes are identical with each other, it becomes possible to realize a light source having a regular shape.

Further, the light source in accordance with one embodiment of the present invention can be arranged such that at least two of the plurality of fluorescent sections have their respective convex parts; and the at least two of the plurality of fluorescent sections are arranged substantially in plane with each other so that their respective convex parts have identical uprising directions.

With the arrangement, the light source in accordance with the embodiment of the present invention is configured such that at least two of the plurality of fluorescent sections have respective convex parts. Since the at least two of the plurality of fluorescent sections have respective convex parts, fluorescent light emitted from the at least two of the plurality of fluorescent sections is unlikely to propagate in a direction perpendicular to the uprising direction of the respective convex parts. This makes it possible to have an increase in a ratio of fluorescent light extracted in the uprising direction of the respective convex parts. For this reason, according to the light source in accordance with the embodiment of the present invention, it is possible to (i) improve efficiency in extracting the fluorescent light in the uprising direction of the respective convex parts, and therefore (ii) improve light-emitting efficiency of the light source.

Note that, by arranging the at least two of the plurality of fluorescent sections substantially in plane with each other so that the respective convex parts have identical uprising directions, it is possible to improve, as much as possible, efficiency in extracting the fluorescent light in the uprising direction of the respective convex parts, in a case where the at least two of the plurality of fluorescent sections are cut out and used as individual light sources. Further, by arranging the at least two of the plurality of fluorescent sections substantially in plane with each other so that the respective convex parts have identical uprising directions, it becomes possible to realize a light source having a regular shape.

Further, the light source in accordance with one embodiment of the present invention can be arranged such that at least one of the plurality of fluorescent sections has a plurality of convex parts.

With the arrangement, the at least one of the plurality of fluorescent sections has a plurality of convex parts. Since the at least one of the plurality of fluorescent sections has a plurality of convex parts, fluorescent light emitted from the at least one of the plurality of fluorescent sections is unlikely to propagate in a direction perpendicular to the uprising direction of the plurality of convex parts. This makes it possible to have an increase in a ratio of fluorescent light extracted in the uprising direction of the plurality of convex parts. For this reason, according to the light source in accordance with the embodiment of the present invention, it is possible to (i) improve efficiency in extracting the fluorescent light in the uprising direction of the plurality of convex parts, and therefore (ii) improve light-emitting efficiency of the light source.

Further, in a case where (i) the at least one of the plurality of fluorescent sections is cut out as a light source and used as an individual light source, and (ii) the excitation light sources are arranged in positions corresponding to the respective plurality of convex parts, it becomes possible to use the light source as a one-dimensional light source or a two-dimensional light source.

Further, the light source in accordance with one embodiment of the present invention can be arranged such that at least one of the plurality of fluorescent sections has a single convex part.

In a case where (i) the at least one of the plurality of fluorescent sections is cut out and used as an individual light source, and (ii) an excitation light source is provided in a position corresponding to the individual light source, it becomes possible to use the individual light source as a dot (point) light source. Further, since the at least one of the plurality of fluorescent sections has a single convex part, fluorescent light emitted from the at least one of the plurality of fluorescent sections is unlikely to propagate in a direction perpendicular to the uprising direction of the single convex part. This makes it possible to have an increase in a ratio of fluorescent light extracted in the uprising direction of the single convex part. For this reason, according to the light source in accordance with the embodiment of the present invention, it is possible to (i) improve efficiency in extracting the fluorescent light in the uprising direction of the single convex part, and therefore (ii) improve light-emitting efficiency of the light source.

Further, the light source in accordance with one embodiment of the present invention can be arranged such that the plurality of fluorescent sections each have a single convex part; and the convex parts are arranged in a matrix manner.

With the arrangement, since the convex parts are arranged in a matrix manner, it is possible to (i) cut out each of the plurality of fluorescent sections, and use as an individual light source, and also (ii) cut out each of the plurality of fluorescent sections by carrying out cutting in any direction.

Moreover, with the arrangement, it is possible to use the light source in accordance with the embodiment of the present invention as a light source without cutting out any one of the plurality of fluorescent sections. It is therefore possible to use, as a planar light source, the light source in accordance with the embodiment of the present invention in such a manner that the plurality of fluorescent sections arranged in a matrix manner and a plurality of excitation light sources provided in positions corresponding to, respectively, the plurality of fluorescent sections are combined with each other.

Further, the light source in accordance with one embodiment of the present invention can be arranged such that the sealing member has at least two convex parts; and the at least two convex parts are arranged substantially in plane with each other so that they have identical uprising directions.

With the arrangement, the sealing member has at least two convex parts. For this reason, it is possible to improve efficiency in extracting the fluorescent light in the uprising direction of the at least two convex parts, even if the plurality of fluorescent sections have no convex part.

Further, the light source in accordance with one embodiment of the present invention can be arranged such that at least one of the plurality of fluorescent sections contains a nanoparticle fluorescent material.

With the arrangement, by changing a particle size of the nanoparticle fluorescent material, it is possible to change a color of light emitted from the nanoparticle fluorescent material by taking advantage of a quantum size effect.

Moreover, the nanoparticle fluorescent material has a feature of being highly resistant to high-power excitation light, because the semiconductor nanoparticle fluorescent material can emit quickly, as fluorescent light, excitation energy. This is because of the fact that an emission lifetime of the semiconductor nanoparticle fluorescent material is approximately 10 nanoseconds, and this emission lifetime is shorter by 5 orders of magnitude than that of a general fluorescent material in which a rare-earth element serves as an emission center. This allows the nanoparticle fluorescent material to repeat quickly absorption of excitation light and emission of fluorescent light.

As a result, it is possible to (i) maintain high efficiency with respect to high-power excitation light and (ii) have a reduction in heat generated by the fluorescent material. It is therefore possible to (i) suppress deterioration (discoloration and/or deformation) due to heat generated by the plurality of fluorescent sections and (ii) prevent a lifetime of the light source from becoming short even with the use of an excitation light source having a high-power optical output.

Further, a light-emitting device in accordance with the present invention includes the light source; and the excitation light source.

By combining, with each other, the excitation light source and various light sources described above, it is possible to realize various light-emitting devices.

Further, a light source for a backlight in accordance with the present invention includes: the light-emitting device; and a light guide plate for guiding light emitted from (i) the excitation light source and (ii) at least one of the plurality of fluorescent sections.

With the arrangement, it is possible to realize a light source for a backlight, which light source includes a light-emitting device and a light guide plate.

Further, a display device in accordance with the present invention includes the light source for a backlight.

With the arrangement, it is possible to realize a display device including the aforementioned light source for a backlight.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention is applicable to a light source having an airtight property, and such a light source can be suitably used in a light-emitting device and the like.

REFERENCE SIGNS LIST

1, 10, 20, 30, 40: Fluorescent material-sealed sheet (light source)
1*a*, 10*a*: One-dimensional light-emitting light source
2: Upper sealing section (sealing member)
3: Lower sealing section (sealing member)
4, 13, 33, 43: Fluorescent section
5: Convex parts
7: LED chip
14: Sealing member
15: Convex parts
50, 55, 80, 90: One-dimensional light-emitting device
60: Two-dimensional light-emitting device
72: Light guide plate
73: Display device

The invention claimed is:

1. A light source comprising:
a plurality of fluorescent sections each emitting fluorescent light upon receipt of excitation light from an excitation light source; and
a sealing member, having translucency, for sealing the plurality of fluorescent sections, wherein:
at least two of the plurality of fluorescent sections have respective convex shapes; and
said at least two of the plurality of fluorescent sections are arranged substantially in plane with each other so that uprising directions of the respective convex shapes are identical to each other.

2. The light source as set forth in claim 1, wherein:
at least one of the plurality of fluorescent sections contains a nanoparticle fluorescent material.

3. A light-emitting device comprising:
a light source recited in claim 1; and
an excitation light source recited in claim 1.

4. A light source for a backlight, comprising:
a light-emitting device recited in claim 3; and
a light guide plate for guiding light emitted from (i) the excitation light source and (ii) at least one of the plurality of fluorescent sections.

5. A display device comprising:
a light source for a backlight, recited in claim 4.

6. A light source comprising:
a plurality of fluorescent sections each emitting fluorescent light upon receipt of excitation light from an excitation light source; and
a sealing member, having translucency, for sealing the plurality of fluorescent sections, wherein:
at least two of the plurality of fluorescent sections have their respective convex parts; and
the at least two of the plurality of fluorescent sections are arranged substantially in plane with each other so that their respective convex parts have identical uprising directions.

7. The light source as set forth in claim 6, wherein:
at least one of the plurality of fluorescent sections has a plurality of convex parts.

8. The light source as set forth in claim 6, wherein:
at least one of the plurality of fluorescent sections has a single convex part.

9. The light source as set forth in claim 8, wherein:
the plurality of fluorescent sections each have a single convex part; and
the convex parts are arranged in a matrix manner.

10. A light source comprising:
a plurality of fluorescent sections each emitting fluorescent light upon receipt of excitation light from an excitation light source; and
a sealing member, having translucency, for sealing the plurality of fluorescent sections, wherein:
the sealing member has at least two convex parts; and
the at least two convex parts are arranged substantially in plane with each other so that they have identical uprising directions.

* * * * *